US006257733B1

(12) United States Patent
Cruz

(10) Patent No.: US 6,257,733 B1
(45) Date of Patent: Jul. 10, 2001

(54) ILLUMINATED WALKING STAFF

(76) Inventor: Albert Cruz, 19 S. Moutain Ave., Melrose, MA (US) 02176

( * ) Notice: Subject to any disclaimer, the term of this patent is extended or adjusted under 35 U.S.C. 154(b) by 0 days.

(21) Appl. No.: 09/396,525

(22) Filed: Sep. 15, 1999

(51) Int. Cl.[7] ..... A45B 3/04
(52) U.S. Cl. ..... 362/102; 362/109; 135/910
(58) Field of Search ..... 362/253, 102, 362/109, 119, 120; 135/66, 86, 82, 910

(56) References Cited

U.S. PATENT DOCUMENTS

D. 242,880 12/1976 Rex, Jr. .
D. 292,346 10/1987 Kolomeyer .
D. 297,887 10/1988 Hattersley .
1,908,662 * 5/1933 Geier ..... 362/102
5,642,931 * 7/1997 Gappelberg ..... 362/102
5,810,466 9/1998 Young .

* cited by examiner

*Primary Examiner*—Thomas M. Sember
(74) *Attorney, Agent, or Firm*—Henry S. Miller

(57) ABSTRACT

A walking staff with a battery powered illuminator unit at one end including a glass sphere and multiple visible light sources positioned so as to create beams of light at selected angles outside the sphere.

12 Claims, 5 Drawing Sheets

ILLUMINATED WALKING STAFF

BACKGROUND OF THE INVENTION

1. Field of the Invention

This invention relates generally to a walking staff, and more specifically to an illuminated walking staff.

2. Description of the Prior Art

Since the earliest of times, man has found it convenient and some times necessary to use various articles to assist in walking. These include the cane, the walking stick and the walking staff. The walking staff being substantially longer than the walking stick, grasped near the middle and in general having some functional or ornamental attachment located at the superior terminus. An example of this is the shepherds staff or the ceremonial staff carried by a Bishop. The prior art is devoid of any staff having an illuminated superior terminus.

Upon examination, the prior art discloses a variety of walking sticks such as those disclose in U.S. Pat. No. D297,887 issued Oct. 4, 1988 to Hattersley. The stick shown includes an elongated shaft, pointed at the inferior end and having a hand grip and wrist strap at the superior end. By length alone this article fails to qualify as a staff, as defined.

In U.S. Pat. No. D292,346 issued Oct. 20, 1987 to Kolomeyer discloses a walking stick or similar article, similar to Hattersley, but flat at each terminus and containing some ornamental design. This is clearly not a staff and it fails to disclose any means for illumination.

In U.S. Pat. No. D242,880 issued Dec. 28, 1976 to Rex, Jr. for a walking stick, shows the typical stick, having a taper on the inferior end a hand grip at the superior end, with an ornamental design in-between.

In U.S. Pat. No. 5,810,466 issued Sep. 22, 1998 to Young, the inventor discloses and describes a walking cane with an illuminated shaft and a flashlight forming the handle. Each lighting means is equipped with its own switch and electrical circuit. Individual power supplies avoids matters associated with co-dependability. The cane of Young clearly fails to show a staff, and an illuminating source as described hereinafter.

The instant invention as disclosed and claimed herein provides distinct and useful advantages not previously known in the prior air.

SUMMARY OF THE INVENTION

The invention is characterized by an elongated staff, generally circular in cross section and of sufficient dimensions to be comfortably held in one hand by the user. At one end is a cover, adapted to protect the of the staff and surfaces it comes in contact with. At the opposed end is a transparent sphere formed of glass or crystal, mounted in a base attached to the staff. The base contains a power supply and switch which controls light emitting means contained in each of three fingers attached to the base which in turn secure the sphere in place. An additional light emitting means is positioned in the base. Each finger is so placed that light emitted passes through the sphere and radiates a beam light from the side distal to the emitter. The light beams are spaced approximately one hundred-twenty degrees apart. Light emitters are not limited to white light but may be of any color in the visible spectrum. Rotation of the staff in an area of low ambient light displays a pleasing view.

It is therefore an object of the invention to provide a new and improved walking staff.

It is another object of the invention to provide a new and improved walking staff that is illuminated.

It is a further object of the invention to provide a new and improved walking staff that radiates beams of light pleasing to the senses.

It is still another object of the invention to provide a new and improved walking staff that adds a safety factor for the user.

It is still a further object of the invention to provide a new and improved walking staff that may be easily and efficiently manufacture and marketed.

These, together with other objects of the invention, along with the various features of novelty which characterize the invention, are pointed out with particularity in the claims annexed to and forming part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will be apparent when consideration is given to the following detailed description thereof. Such description makes reference to the annexed drawings wherein.

DETAILED DESCRIPTION OF A PREFERRED EMBODIMENT

Figure 1:
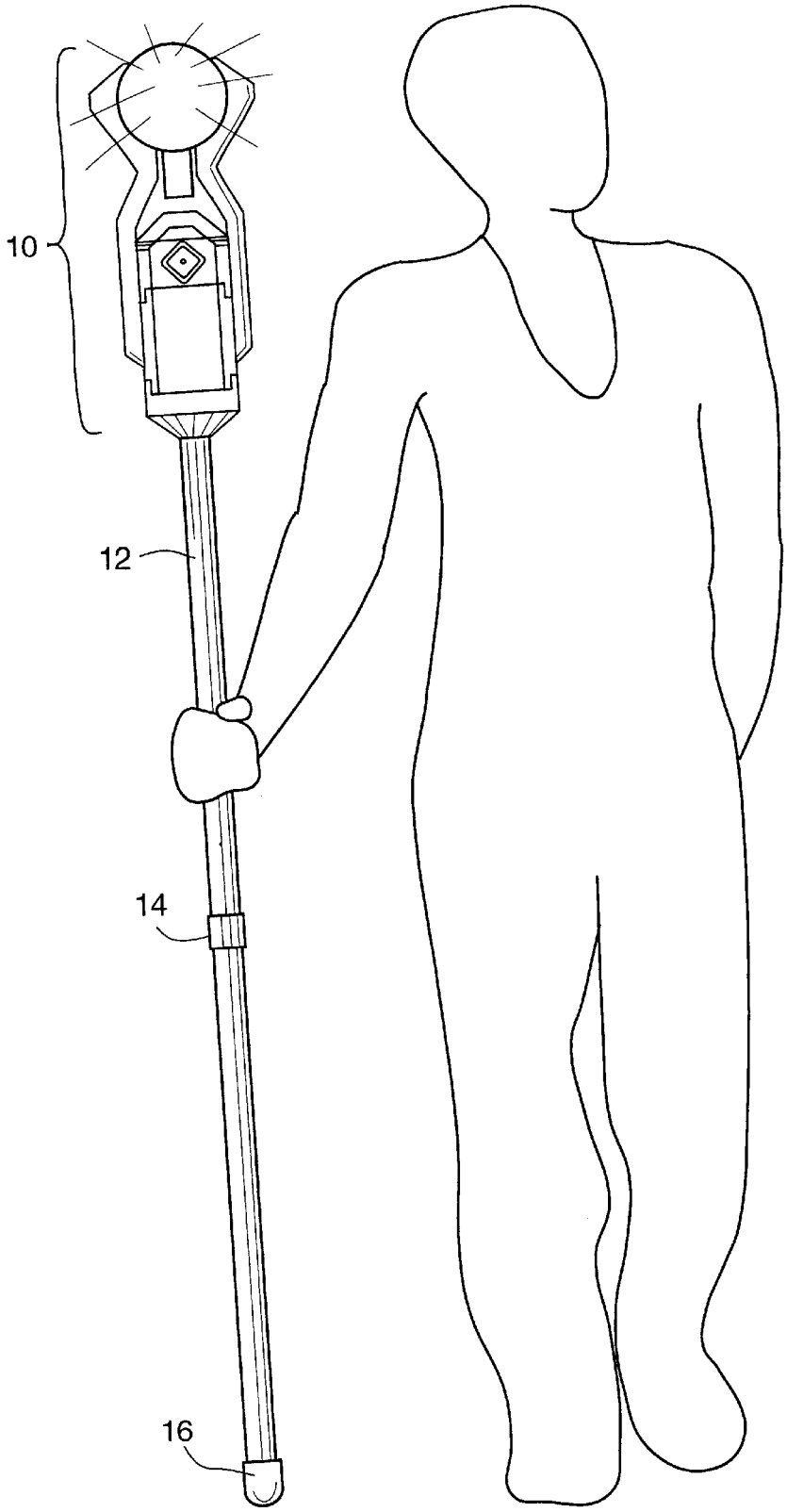
FIG. 1. Is an environmental view of the invention.

Referring now to FIG. 1, the invention is characterized by an illuminator unit 10 connected to an elongated rod 12 forming the shaft. The staff, is generally circular in cross section. For convenience a coupling member 14 may be placed at mid shaft to allow the shaft to be disassembled for storage or other reasons. The inferior terminus of the shaft, which strikes the ground is protected by a cap 16 which may formed from rubber or high impact plastic. In the preferred embodiment the shaft is hollow and formed from any suitable currently available metal although wood or plastic would work equally as well. Coupling (14) may be connected to the shaft sections by threaded engagement or a tight sliding fit.

Figure 2:
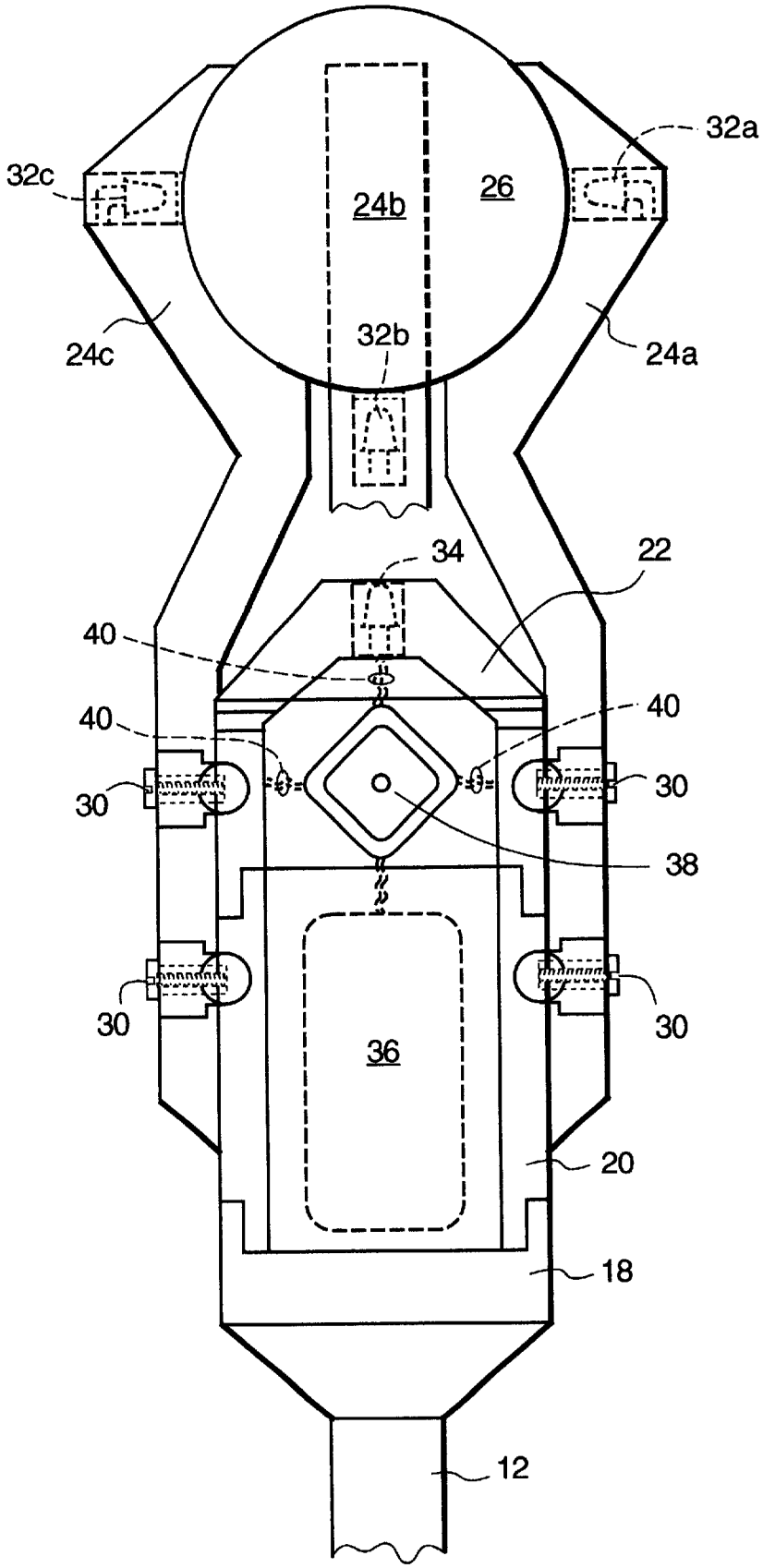
FIG. 2. Is a side elevation view of the illuminating structure, partly in cross section.
Figure 3:
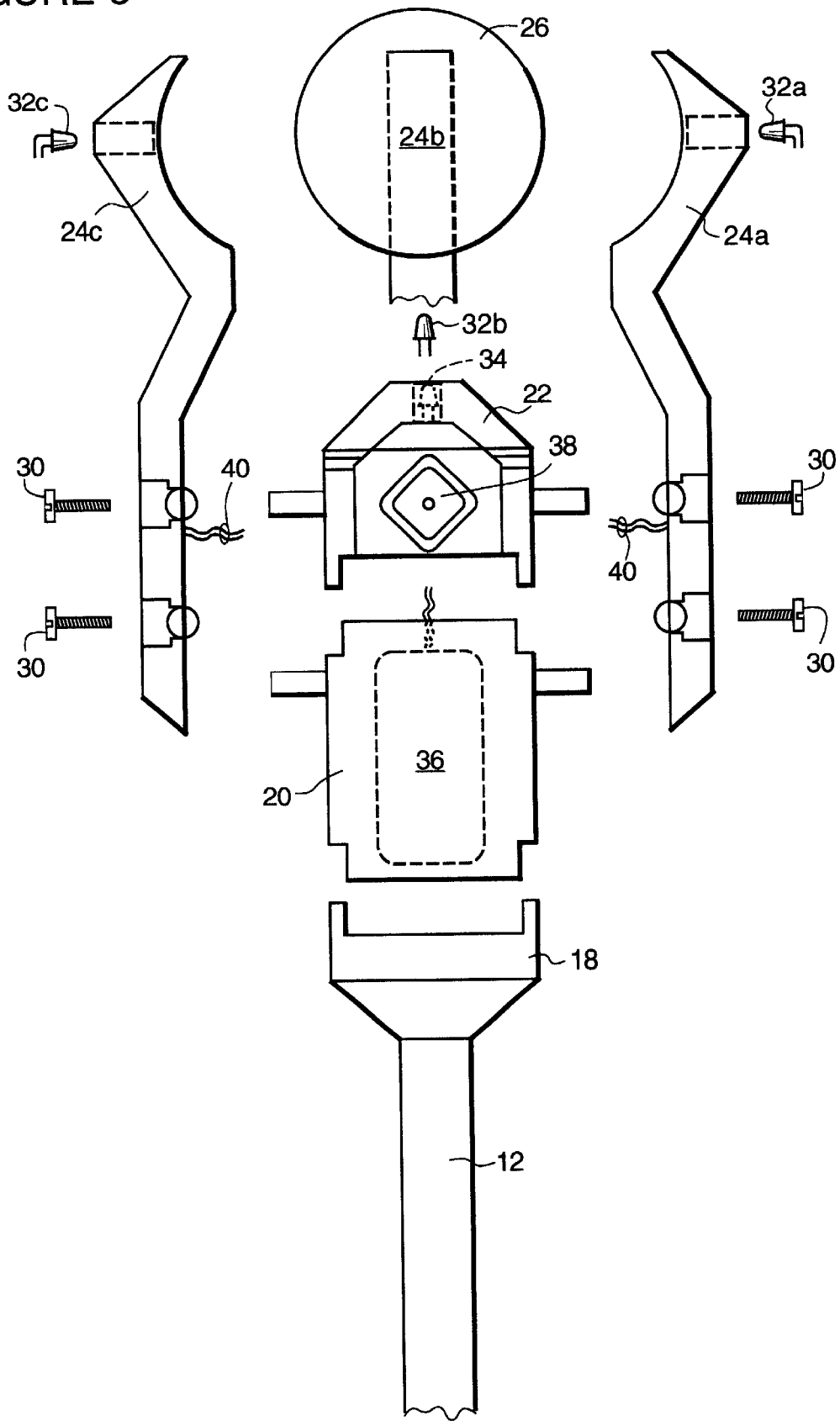
FIG. 3. Is an exploded view of the illuminating structure.

Concerning FIGS. 2 and 3, the illuminator 10, is permanently affixed to the superior terminus of shaft 12 by appropriate means, for example welding in the case of a metal shaft. The illuminator consists of a base 18 supporting a body 20 and a cap 22. Attached to the body 20 are three hollow finger supports 24*a,* 24*b* and 24*c* which are designed to grasp and hold glass sphere 26. Light emitting diodes 32*a,* 32*b,* 32*c* contained in the fingers pass light through the sphere and radiate beams of light in a common horizontal plane outside the sphere. The fingers are attached to the body 20 and cap 22 by appropriate fasteners 30. An additional light emitter 34 is located in cap 22 and radiates a beam of light through the sphere in a plane perpendicular to the horizontal plane created by the other light emitters.

The light emitting diodes are powered by a nine volt battery 36 operating through switch 38 and leads 40. Leads

40 are routed from the switch through the hollow fingers to light emitting diodes 32*a,* 32*b,* 32*c.*

Figure 4:
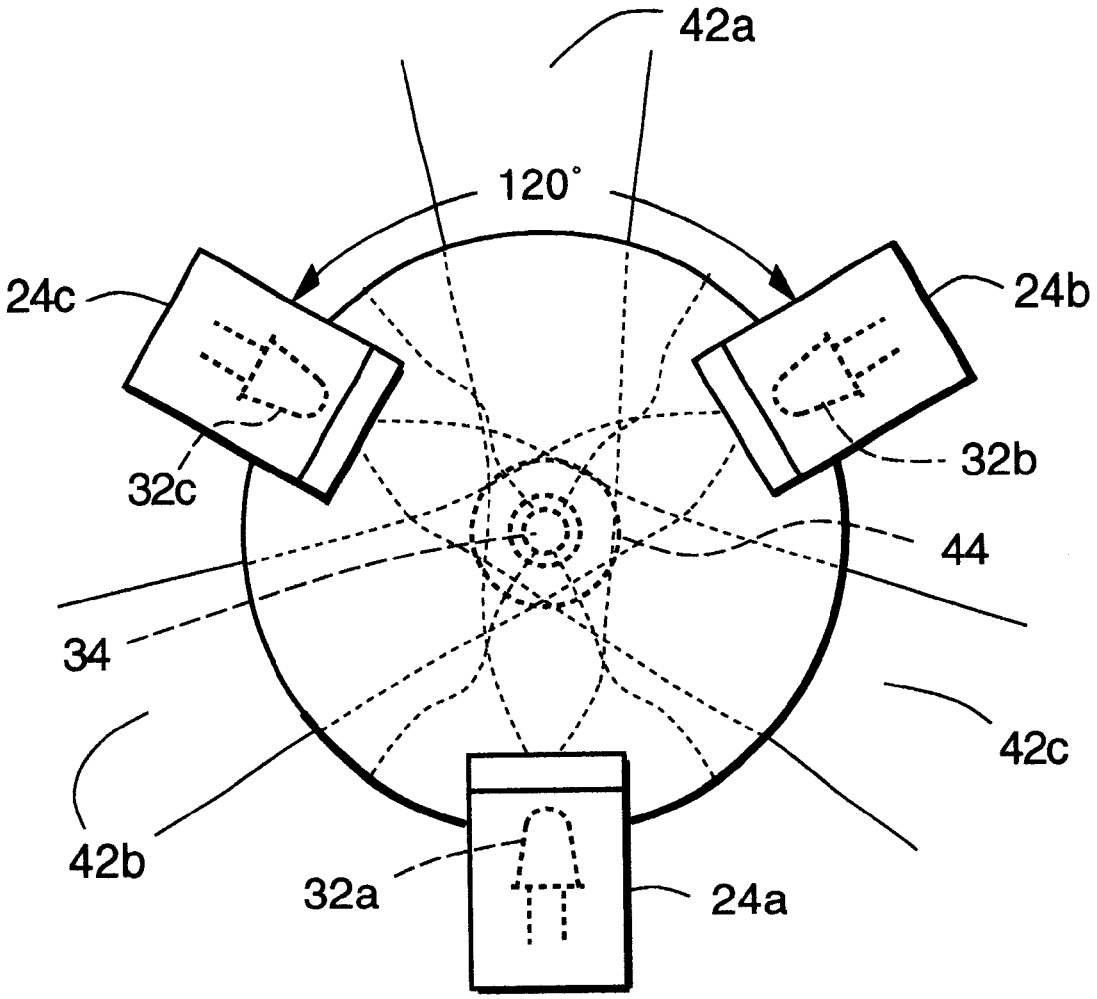
FIG. 4. Is a top view of the sphere showing beams of light emanating from the securing fingers.

FIG. 4 shows sphere 26 as it is grasped by fingers 24*a,* 24*b* and 24*c.* Each wide angle light emitting diode 32*a,* 32*b* and 32*c,* located in a finger, causes light to pass through the sphere and radiate into the space beyond the surface of the sphere in the form of a beam 42*a,* 42*b* and 42*c.* Light emitting diode 34 produces beam 44 which is perpendicular to the plane of the other beams. The fingers 24 are spaced at one hundred twenty degrees around the sphere. These the illuminator gives off four beams of light. The wave length of the light is immaterial so long as it radiates a wavelength within the visible spectrum.

Figure 5:
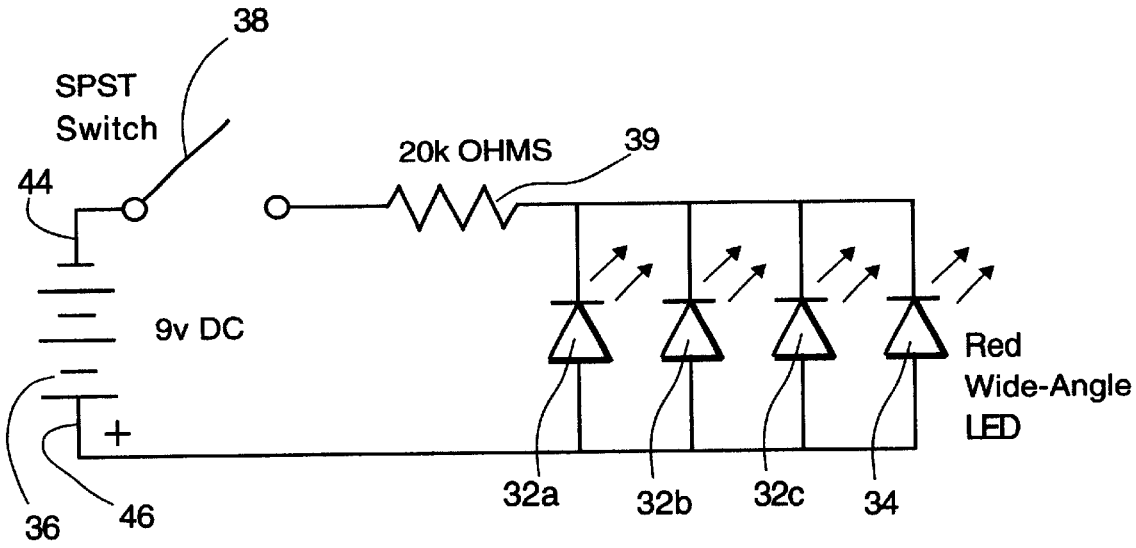
FIG. 5. Is a schematic drawing of the circuit of the invention.

FIG. 5 shows an electrical circuit diagram for the illuminator 10. Power is supplied by a battery of a common 9 volt variety. The circuit is controlled by single pole single throw switch 38 which allows voltage to pass load resister 39. Light emitting diodes 32*a,* 32*b,* 32*c* and 34 are connected in electrical parallel between leads 44,46 originating at the terminals of battery 36.

The foregoing description and drawings of the invention are explanatory and illustrative only, and various changes in shape, sizes and arrangements of parts as well certain detail of illustrated construction may be made within the scope of the appended claims without departing from the spirit of the invention.

What is claimed as being new and desired to be protected by Letters Patent of the United States is as follows:

1. An illuminated walking staff comprising:

a shaft of substantial relative length having opposed ends;

a protective means covering a first end;

an illuminating means affixed to a second end including, an enclosure, having a source of visible light operatively associated with the enclosure, wherein the enclosure comprises:

a base;

a cylindrically shaped body, removably attached to the base;

a cover removably attached to the shaped body;

wherein the illuminating means further includes:

a transparent sphere positioned distally to the enclosure, supported by hollow finger members, adapted for grasping a sphere, removably attached to said base and cover.

2. An illuminated walking staff according to claim 1 wherein: the sphere support means includes three hollow finger members.

3. An illuminated walking staff according to claim 2 wherein: each finger includes means for illuminating.

4. An illuminated walking staff according to claim 3 wherein: the cover includes means for illuminating.

5. An illuminated walking staff according to claim 4 wherein: the body includes an electrical switch.

6. An illuminated walking staff according to claim 5 including a power supply located in the said body.

7. An illuminated walking staff according to claim 6 including: an electrical supply circuit connected through the switch and between the power supply and the means or illuminating.

8. An illuminated walking staff according to claim 7 wherein: the means for illuminating include light emitting diodes.

9. An illuminated walking staff according to claim 8 wherein: the light emitting diodes are of the wide angle type.

10. An illuminated walking staff according to claim 9 wherein: the sphere is formed of glass.

11. An illuminated walking staff according to claim 10 wherein: light from the illuminating means passes through the sphere.

12. An illuminated walking staff according to claim 11 wherein: light radiated from the illuminating means located in each finger passes through a common plane.

* * * * *